US005631453A

United States Patent [19]

Maeda

[11] Patent Number: 5,631,453

[45] Date of Patent: May 20, 1997

[54] MULTI-WAY FLIPPING SWITCH

[75] Inventor: Takuya Maeda, Furukawa, Japan

[73] Assignee: Alps Electric Co., Ltd., Tokyo, Japan

[21] Appl. No.: 437,199

[22] Filed: May 8, 1995

[30] Foreign Application Priority Data

May 12, 1994 [JP] Japan ..... 6-098690

[51] Int. Cl.[6] ..... H01H 25/04

[52] U.S. Cl. ..... 200/6 A

[58] Field of Search ..... 200/4, 5 R, 5 A, 200/6 R, 6 A, 16 R, 17 R, 18, 332, 335, 339

[56] References Cited

U.S. PATENT DOCUMENTS

| | | | |
|---|---|---|---|
| 4,124,787 | 11/1978 | Aamoth et al. | 200/6 A |
| 4,439,648 | 3/1984 | Reiner et al. | 200/6 A |
| 4,687,200 | 8/1987 | Shirai | 273/148 B |
| 4,710,602 | 12/1987 | Baity et al. | 200/315 |
| 4,816,662 | 3/1989 | Kyoden | 200/5 R |
| 5,329,278 | 7/1994 | Dombroski | 341/20 |
| 5,468,924 | 11/1995 | Naitou et al. | 200/6 A |

FOREIGN PATENT DOCUMENTS

| | | | |
|---|---|---|---|
| 59-170342 | 11/1984 | Japan | H01H 25/04 |
| 59-170338 | 11/1984 | Japan | H01H 21/22 |
| 62-92535 | 6/1987 | Japan | H01H 23/30 |

*Primary Examiner*—Michael L. Gellner
*Assistant Examiner*—Michael A. Friedhofer
*Attorney, Agent, or Firm*—Guy W. Shoup; Patrick T. Bever

[57] ABSTRACT

A multi-way flipping switch including a base plate having stationary contacts, a click rubber member placed on the base plate and having hollow protrusions located over the stationary contacts, movable contacts mounted on inner surfaces of the hollow protrusions, a housing mounted on the base plate having a central opening, a holding member mounted on the housing, rotating members having one end rotatably mounted on the holding member and a second end contacting an upper surface of the hollow protrusions, and an operating member pivotally mounted on the housing such that a portion of the operating member protrudes through the central opening, the operating member including driving members contacting middle sections of the rotating members. In operation, pivoting of the operation member in an arbitrary direction causes rotation of one of the rotating members, thereby driving the end of the rotating member downward against the upper surface of a corresponding hollow protrusion, and thereby collapsing the hollow protrusion such that the movable contact located inside the hollow protrusion contacts a corresponding stationary contact on the base plate. The upper surface of each of the hollow protrusions is curved such that the corresponding rotating member contacts the upper surface at a point.

6 Claims, 4 Drawing Sheets

MULTI-WAY FLIPPING SWITCH

BACKGROUND OF THE INVENTION

1. Field of the Invention

The present invention relates to a multi-way flipping switch applicable to an automotive mirror driving device or the like and adapted to output an electric signal corresponding to a direction of inclination of an operating member.

2. Description of the Related Art

Japanese Utility Model Laid-Open No. 59-188644 discloses a conventional example of such a multi-way flipping switch, which comprises an operating member held so as to be capable of being inclined in a number of directions, a base plate having a plurality of stationary contacts, a click rubber member in the form of a sheet having a plurality of hollow protrusions each containing a movable contact, a driving member arranged between the operating member and the base plate and adapted to transmit an inclining force for the operating member to the above-mentioned hollow protrusions, and a spring for restoring the operating member and the driving member to a neutral position. In this conventional multi-way flipping switch, when the operating member is inclined in an arbitrary direction against the resilient force of the spring, the hollow protrusion of the click rubber member positioned in the direction of inclination is pressed by the driving member to generate a click feel and, at the same time, the movable contact provided in this hollow protrusion is brought into contact with the stationary contact arranged opposite thereto, whereby an electric signal corresponding to the direction of inclination can be output. When the operating force causing the inclination of the operating member is cancelled, the driving member and the operating member are restored to the neutral position by the resilient force of the spring and, at the same time, the hollow protrusion is restored to the non-operating state by its own resilient force, with the result that the movable contact is separated from the stationary contact and returns to the original position, which corresponds to the OFF state.

Japanese Utility Model Publication No. 3-23639 discloses another example of conventional multi-way flipping switch, which comprises an operating member, a base plate having a plurality of stationary contacts, and a sheet-shaped click rubber member having a plurality of hollow protrusions each containing a movable contact, wherein the operating member is provided with a longer projection and a plurality of shorter projections positioned around the longer projection, with the lower surface of the projections respectively abutting the hollow protrusions of the click rubber member. In this multi-way flipping switch, when the operating member is inclined in an arbitrary direction, the hollow protrusion positioned in the direction of inclination is pressed by the corresponding projection. The top end surface of each hollow protrusion is formed as an inclined surface descending toward the center, so that the top end section of the hollow protrusion is parallel to the surface of the base plate when the operating member is inclined. As a result, the movable contact inside the hollow protrusion is reliably brought into contact with the associated stationary contact, thereby providing a satisfactory contact state. Further, when the operating member is inclined by a predetermined angle, a part of the lower end section of the protrusion is passed through a through-hole of the click rubber member to abut the base plate, whereby the angle of inclination of the operating member is restricted, thereby preventing two or more pairs of switching elements from being simultaneously brought into the ON state.

Further, as disclosed in Japanese Utility-Model Laid-Open No. 59-33640, there has been proposed a multi-way flipping switch, in which a protrusion protruding upwards beyond a housing is provided on an operating member, and in which a cross guide groove to be engaged with this protrusion is provided in the housing. In this multi-way flipping switch, the direction of inclination of the operating member is restricted to four directions by the above-mentioned guide groove, so that it is possible to prevent two or more pairs of switch elements from being simultaneously brought to the ON state.

In the multi-way flipping switch disclosed in Japanese Utility-Model Laid-Open No. 59-188644, in which the operating member and the driving member are held in the neutral state by using a spring, has a problem in that, when the resilient force of the spring for restoring the operating member from the inclined to the neutral state is set at a high level so as to reliably achieve the neutral state, the click feel generated in the hollow protrusion of the click rubber member is reduced by the resilient force of the spring, thereby impairing the operating feel (the click feel). The click feel might be enhanced by setting the resilient force of the spring at a low level. In that case, however, the restoring force for retaining the operating member and the driving member in the neutral state would become rather weak, resulting in the neutral state of the operating member becoming rather unstable. Further, when, after the buckling deformation of the above-mentioned hollow protrusion, the inclining force is further applied to the operating member, the driving member will reversely rotate on the buckled hollow protrusion, thereby eliminating the stop feel indicating the termination of the inclining operation. From this viewpoint also, this prior-art structure is subject to impairment of the operating feel.

In the multi-way flipping switch described in Japanese Utility Model Publication No. 3-23639, in which an inclined surface descending toward the center is formed on the surface of the top end portion of each hollow protrusion, whereby the movable contact can be reliably brought into contact with the stationary contact while being held in a parallel position to the stationary contact. However, such an asymmetrical hollow protrusion not only impairs the operating feel, but also complicates the molding process for the click rubber member, thereby leading to an increase in production cost. Further, in this prior-art structure, in which the protrusion provided on the operating member is brought into abutment with the hard base plate to thereby prevent two or more pairs of switching elements from being simultaneously turned on, has a problem in that a through-hole into which the protrusion is to be passed has to be provided in the click rubber member, placed on the base plate, so that there is the danger of some liquid, such as water or juice, intruding the base plate through this through-hole to thereby generate electrical trouble, etc.

In the multi-way flipping switch described in Japanese Utility Model Laid-Open No. 59-33640, in which the projection of the operating member moves along the guide groove of the housing when the operating member is inclined, has a problem in that, when, for example, the operating member is to be sequentially inclined in two different directions, it is necessary to first restore the operating member, after its inclination in one direction, to the neutral position before the operating member can be inclined in the other direction along the guide groove, so that a quick operation is not to be expected.

SUMMARY OF THE INVENTION

The present invention has been made in view of the above problems in the prior art. A first object of the present invention is to provide a multi-way flipping switch which helps to attain an improvement in operability. A second object of the present invention is to provide a multi-way flipping switch in which the movable contact can be reliably brought into contact with the stationary contact to thereby attain a stable contact state and which is inexpensive and provides an excellent operating feel. A third object of the present invention is to provide a multi-way flipping switch which is capable of preventing two or more pairs of switching elements from being simultaneously turned on while securing the requisite waterproofness for the contact section and which allows the input operation to be quickly conducted.

The first object of the present invention can be achieved by a multi-way flipping switch comprising: a housing having an opening; an operating member partly protruding beyond the opening and retained so as to be capable of being inclined in a number of directions; a base plate on which a plurality of stationary contacts are arranged; a click rubber member having a plurality of hollow protrusions protruding in the direction of the operating member; and a plurality of movable contacts respectively provided on the inner surfaces of the top end portions of the hollow protrusions, the operating member being adapted to be inclined in an arbitrary direction to thereby cause the corresponding movable contact to be brought into contact with the associated stationary contact, wherein rotating members for transmitting the inclining operational force of the operating member to the hollow protrusions are arranged between the operating member and the click rubber members, and wherein the operating member has driving sections for driving these rotating members, each driving section being set such that it acts on the associated rotating member at a position between the fulcrum in rotation of this rotating member and that section of this rotating member which presses the associated hollow protrusion.

The second object of the present invention can be achieved by a multi-way flipping switch comprising: a housing having an opening; an operating member partly protruding beyond the opening and retained so as to be capable of being inclined in a number of directions; a base plate on which a plurality of stationary contacts are arranged; a click rubber member having a plurality of hollow protrusions protruding the direction of the operating member; and a plurality of movable contacts respectively provided on the inner surfaces of the top end portions of the hollow protrusions, the operating member being adapted to be inclined in an arbitrary direction to thereby cause the corresponding movable contact to be brought into contact with the associated stationary contact, wherein rotating members for transmitting the inclining operational force of the operating member to the hollow protrusions are provided between the operating member and the click rubber members, and wherein the surface of the top end portion of each hollow protrusion is formed as a curved surface.

The third object of the present invention can be achieved by a multi-way flipping switch comprising: a housing having an opening; an operating member partly protruding beyond the opening and retained so as to be capable of being inclined in a number of directions; a base plate on which a plurality of stationary contacts are arranged; a click rubber member having a plurality hollow protrusions protruding in the direction of the operating member; and a plurality of movable contacts respectively provided on the inner surfaces of the top end portions of the hollow protrusions, the operating member being adapted to be inclined in an arbitrary direction to thereby cause the corresponding movable contact to be brought into contact with the associated stationary contact, wherein a plurality of rotating members driven by the operating member so as to press the hollow protrusions, and a holding member for rotatably holding the rotating members, are provided between the operating member and the click rubber member, and wherein protrusions for restricting the direction of inclination of the operating member are provided on either the operating member or the holding member.

In the multi-way flipping switch according to a first embodiment of the present invention, when the operating member is inclined, the middle section of the corresponding rotating member is driven by the operating member, and the rotating member rotates using one end thereof as a fulcrum of rotation (pivot point), the other end thereof pressing the surface of the top end portion of the associated hollow protrusion, so that, as is obvious from the principle of the lever, it is possible to set the requisite operating force for operating the operating member at a level higher than the pressing force applied to the top end surface of the hollow protrusion. Further, since the operating member is restored to the neutral position by utilizing the resilient force of the hollow protrusion of the click rubber member, the click feel caused by the buckling deformation of the hollow protrusion is not impaired by another member such as a spring, so that the operating feel obtained in response to the buckling deformation is a satisfactory one, thereby making it possible to achieve an improvement in terms of operability.

In the multi-way flipping switch according to a second embodiment of the present invention, when the operating member is inclined in an arbitrary direction, the rotating member arranged in the direction of inclination is driven by the operating member, and the rotating member rotates to press the top end surface of the associated hollow protrusion. Since the top end surface of the hollow protrusion is formed as a curved surface, the rotating member and the hollow protrusion are in point contact with each other, and, in this condition, the contact position moves with the rotation of the rotating member, so that a directly downward pressing force is constantly applied to the hollow protrusion. Thus, the inner surface of the top end portion of the hollow protrusion is kept parallel to the surface of the base plate even when the hollow protrusion is being buckled. As a result, the movable contact on the inner surface of the top end portion is reliably brought into contact with the corresponding stationary contact of the surface, thereby providing a stable contact state. Further, since the hollow protrusion has a symmetrical configuration, the operator experiences a satisfactory operating feel when the hollow protrusion undergoes buckling deformation. Further, it is possible to avoid a complication of the process for molding the click rubber member, thereby attaining a reduction in production cost.

In the multi-way flipping switch according to a third embodiment of the present invention, the direction of inclination of the operating member is restricted by protrusions provided on at least either the operating member or the holding member, so that it is possible to prevent two or more pairs of switching elements from being simultaneously turned on while preventing intrusion of liquid from the click-rubber-member side to the base plate. Further, when the operating member is to be inclined sequentially in two or more different directions, the operating member, having been inclined in one direction, can be directly inclined in the other direction without having to first restored to the neutral position, thereby expediting the operation.

DESCRIPTION OF THE PREFERRED EMBODIMENTS

An embodiment of the present invention will now be described with reference to the drawings.

Figure 1:
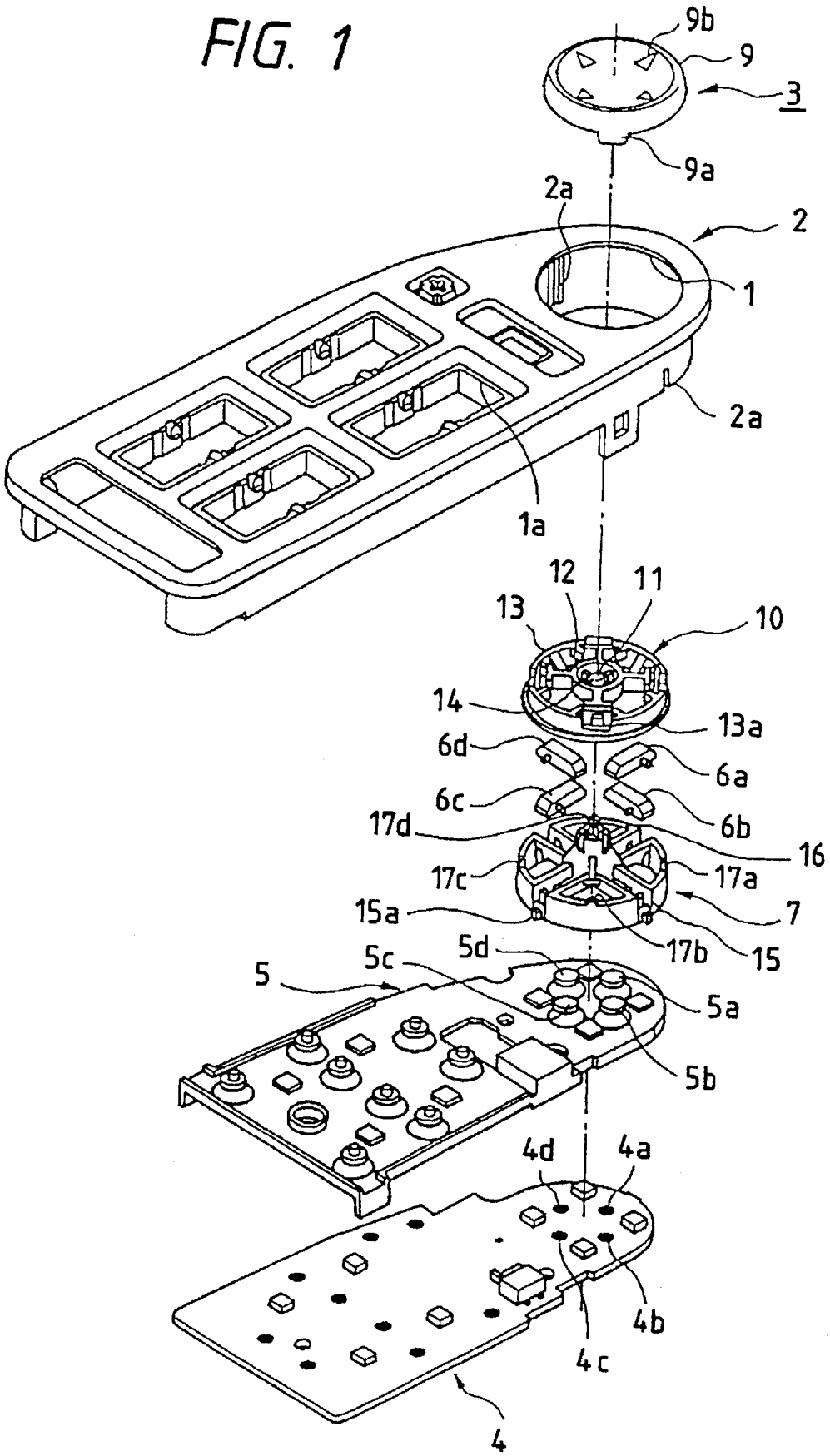
FIG. 1 is an exploded perspective view of a multi-way flipping switch according to an embodiment of the present invention.
Figure 2:
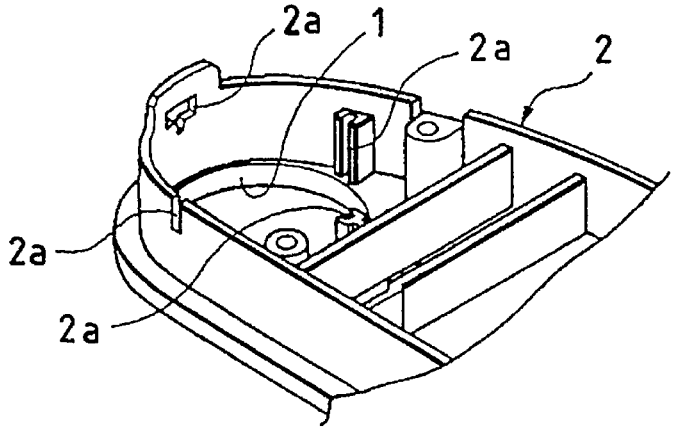
FIG. 2 is a back side perspective view of a part of a housing with which the multi-way flipping switch is equipped.
Figure 3:
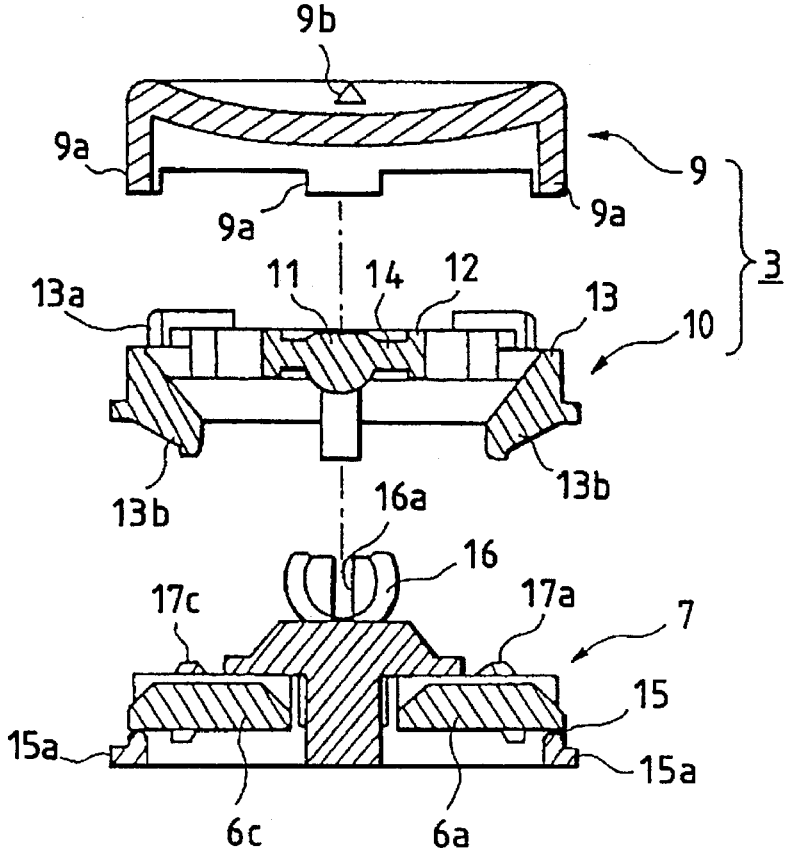
FIG. 3 an exploded sectional view showing an operating member, a holding member and rotating members with which the multi-way flipping switch is equipped.
Figure 4:
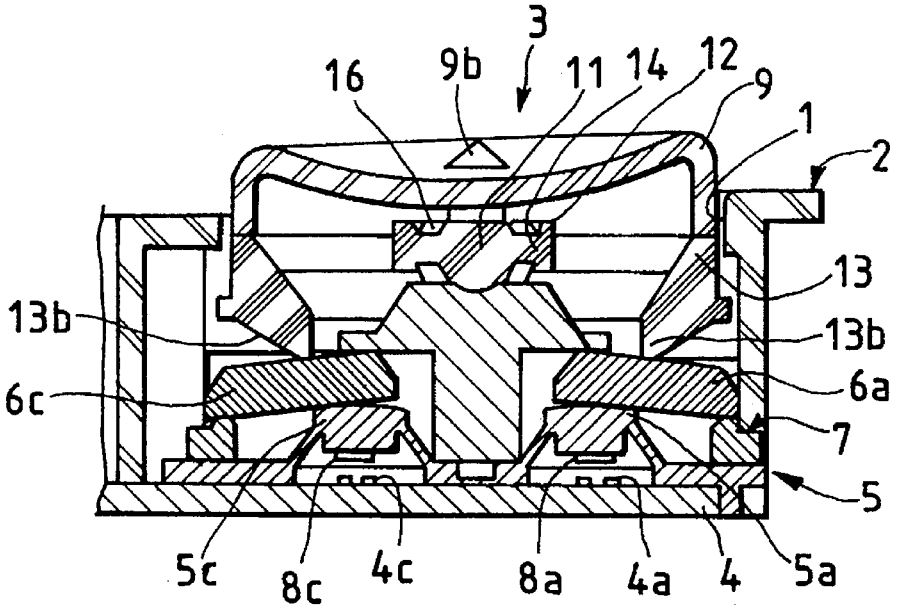
FIG. 4 is a sectional view showing the multi-way flipping switch in the non-operating state.
Figure 5:
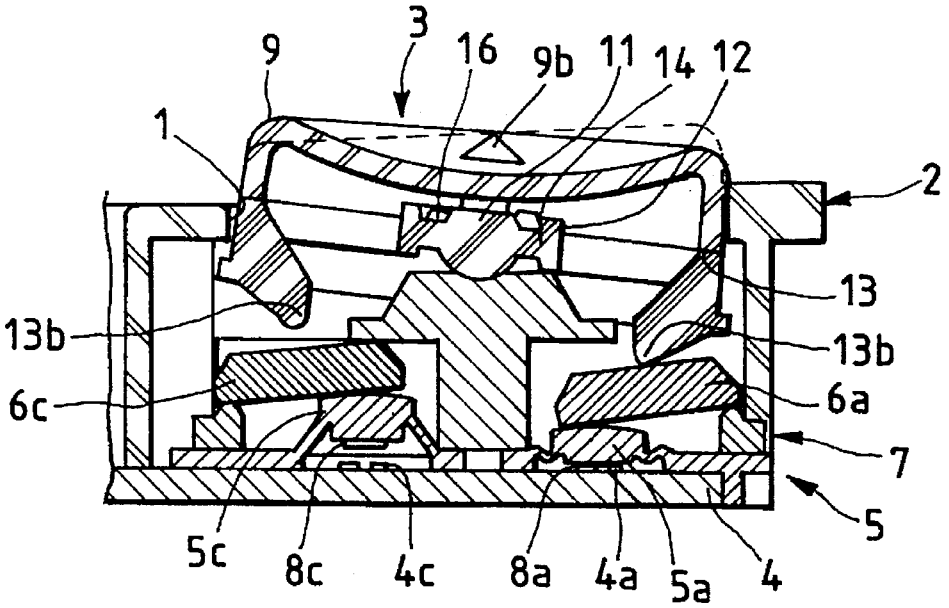
FIG. 5 is a sectional view showing the multi-way flipping switch in the operating state.
Figure 6A:
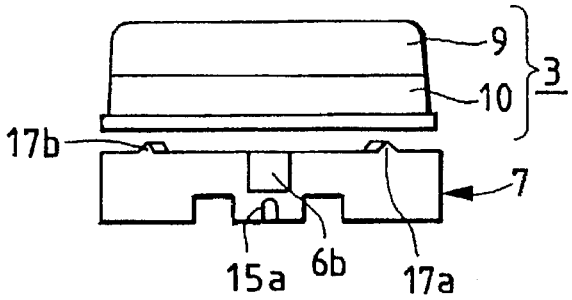
FIGS. 6A, 6B, 6C and 6D are diagrams illustrating the range of inclination for the operating member of the multi-way flipping switch.
Figure 6B:
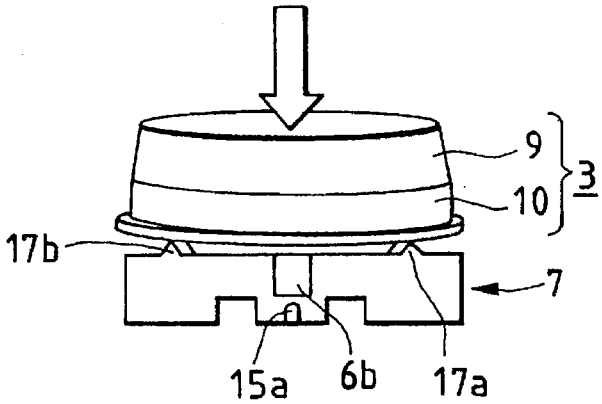
Figure 6C:
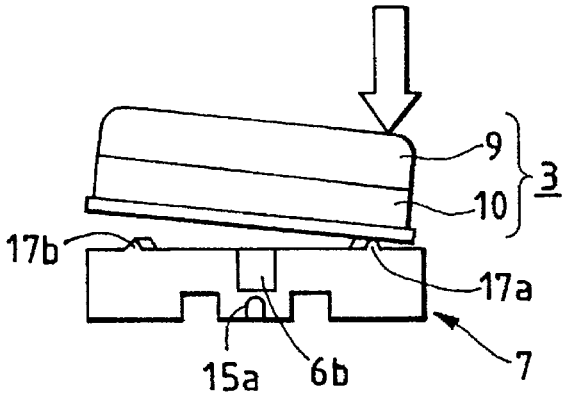
Figure 6D:
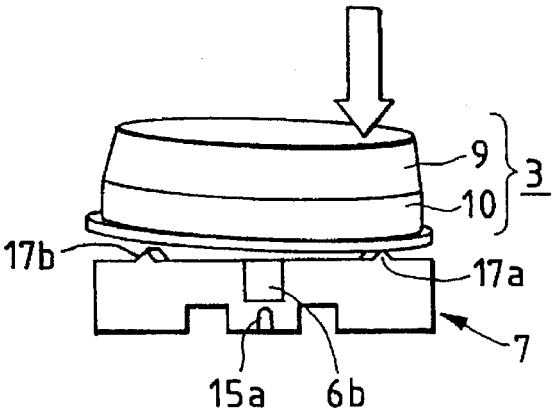

FIG. 1 is an exploded perspective view of a multi-way flipping switch according to an embodiment of the present invention; FIG. 2 is a back side perspective view of a part of a housing with which the multi-way flipping switch is equipped; FIG. 3 is an exploded sectional view showing an operating member, a holding member and rotating members with which the multi-way flipping switch is equipped; FIG. 4 is a sectional view showing the multi-way flipping switch in the non-operating state; FIG. 5 is a sectional view showing the multi-way flipping switch in the operating state; and FIG. 6 is a diagram illustrating the range of inclination for the operating of the multi-way flipping switch. FIG. 6A is a diagram showing the operating member in the non-operating state; FIG. 6B is a diagram showing the operating member inclined toward this side; FIG. 6C is a diagram showing the operating member inclined to the right; and FIG. 6D is a diagram showing the operating member inclined obliquely to the right.

The multi-way input switch of the embodiment shown in FIG. 1 mainly comprises: a housing 2 constituting the outer casing and having an opening 1, through-holes 1*a* and so on; an operating member 3 partly protruding beyond the opening 1 and retained so as to be capable of being inclined in a number of directions; a base plate 4 equipped with four stationary contacts 4*a*–4*d* arranged around a point corresponding to the center of the operating member 3 at an equal angular interval of approximately 90°; a click rubber member 5 placed on the base plate 4; four rotating members 6*a*–6*d* arranged between the operating member 3 and the click rubber member 5; and a holding member 7 for holding the rotating member 6*a*–6*d*. The holding member 7 is secured inside the housing 2. Other operating members are attached to the through-holes 1*a*.

The click rubber member 5 has hollow protrusions 5*a*–5*d*, etc. protruding toward the operating member 3 and each having a space inside. The hollow protrusions 5*a*–5*d* are respectively positioned above the stationary contacts 4*a*–4*d* of the base plate 4. As shown in FIG. 4, the top end surface of each of the hollow protrusions 5*a* and 5*c* is formed as an upwardly swollen curved surface, and movable contacts 8*a* and 8*c* that are respectively opposed to the stationary contacts 4*a* and 4*c* are respectively provided on the inner side of the top end surface of each of the hollow protrusions 5*a* and 5*c*. Similarly, the top end surface of each of the hollow protrusions 5*b* and 5*d* is also formed as an upwardly swollen curved surface, and movable contacts 8*b* and 8*d* that are respectively opposed to the stationary contacts 4*b* and 4*d* are respectively provided on the inner side of the top end surface of each of the hollow protrusions 5*b* and 5*d*.

The operating member 3 is composed of a plastic operating knob 9 protruding beyond the opening 1, and a plastic base 10 attached to the lower side of the operating knob 9. As stated below, the operating knob 9 and the base 10 are formed as an integral unit. The operating knob 9 has four engagement sections 9*a* extending downwards from its periphery, and the surface of the operating knob 9 is formed as a concave surface having four arrows 9*b* indicating the operating directions of the operating member 3. The base 10 is molded as a one-piece member composed of a spherical section 11 arranged at the center, an inner annular section 12 joined to the spherical section 11, and an outer annular section 13 joined to the inner annular section 12. The outer annular section 13 has four elastic sections 13*a* respectively corresponding to the engagement sections 9*a*, and four driving sections 13*b* extending downwardly so as to respectively press the middle section of each of the rotating members 6*a*–6*d*. The engagement sections 9*a* and the elastic sections 13*a* are joined together by a snapping engagement, thereby integrally joining the operating knob 9*a* and the base 10 with each other. The spherical section 11 and the inner annular section 12 are joined together through the intermediation of joint sections 14, which extend from the spherical section 11 and radially arranged at equal angular intervals of approximately 90°.

The holding member 7 is molded as an integral unit consisting of an annular section 15 to be placed on the click rubber member 5 and an accommodating section 16 joined to the annular section 15 and adapted to accommodate the spherical section 11. The annular section 15 has four outward protrusions 15*a*, which are respectively engaged with engagement grooves 2*a* formed in the housing 2, whereby the holding member 7 is attached to the housing 2. Pyramidal protrusions 17*a*–17*d*, which abut the outer annular section 13 of the base 10 when the operating member 3 is inclined, are integrally formed on the annular section 15. As stated below, the range of inclination for the operating member 3 is restricted by these pyramidal protrusions 17*a*–17*d*. The rotating members 6*a*–6*d* are rotatably held by the annular section 15, each rotating member using the outer end portion thereof as a fulcrum in rotation. When the upper surface of the middle section of one of the rotating members 6*a*–6*d* is rotated by the operating member 3, the top end surface of the corresponding one of the hollow protrusions 5*a*–5*d* is pressed by the inner end portion of this rotating member. The rotating members 6*a*–6*d* and the protrusions 17*a*–17*d* are alternately arranged around the accommodating section 16 at an equal angular interval of approximately 90°. The inner surface of the accommodating section 16 is formed as a spherical surface having an inner diameter substantially equal to the outer diameter of the spherical section 11, and slits 16*a* for accommodating the joint section 14 of the operating member 3 are radially formed in the accommodating section 16 at an equal angular interval of approximately 90°. The accommodating section 16 accommodates the spherical section 11 to rotatably hold the spherical section 11.

In assembling this multi-way flipping switch, constructed as described above, the engagement members 9*a* are first snapped in the elastic members 13*a*, thereby integrally combining the operating knob 9 and the base 10 to complete the operating member 3. The rotating members 6*a*–6*d* are incorporated into the holding member 7, and the spherical section 11 of the operating member 3 is fitted into the accommodating section 16 of the holding member 7, thereby integrally joining the holding member 7 with the operating member 3. As a result, the joint sections 14 of the base 10 are fitted into the slits 16*a* of the accommodating section 16, and the operating knob 9 is prevented from circumferentially rotating around the spherical section 11, so that the indicating arrows 9*b* of the operating knob 9*b* are prevented from becoming out of alignment. Subsequently, the holding member 7 and the operating member 3, thus integrated, are incorporated into the housing 2, and the protrusions 15*a* of the holding member 7 are engaged with the engagement grooves 2*a*. By thus engaging the four protrusions 15*a* of the holding member 7 respectively with the engagement grooves 2*a* of the housing 2, the holding member 7 is secured in position with respect to the housing 2, so that it is possible to correctly position the holding member 7 with respect to the base plate 4 and the click rubber member 5 in the housing 2.

Next, the operation of this multi-way flipping switch, thus assembled, will be described.

FIG. 4 shows the non-operating state. In this condition, when the operator pushes a peripheral section of the operating knob 9, for example, the right-hand section thereof (as seen in the drawing), the operating member 3 is inclined clockwise as seen in FIG. 4 around the spherical section 11 since the spherical section 11 of the operating member 3 is held in the accommodating section 16. Thus, the pressed section (the right-hand section) of the operating knob 9 descends. As the pressed section descends, the driving member 13*b* on the right-hand side (as seen in the drawing) of the base 10 drives the middle section of the rotating member 6*a*, so that the rotating member 6*a* rotates counterclockwise by using the right-hand end thereof (FIG. 4), which is in contact with the annular section 15 of the holding member 7, as the rotation fulcrum. As a result, the hollow protrusion 5*a* of the click rubber member 5 is pressed by the other end of the rotating member 6*a* and thereby buckled. This buckling deformation of the hollow protrusion 5*a* generates a click feel. At the same time, as shown in FIG. 5, the movable contact 8*a* is brought into contact with the stationary contact 4*a*, as shown in FIG. 5. The stationary contact 4*a* is turned on through the movable contact 8*a* to conduct, thereby outputting a predetermined electric signal. When the operating knob 9 thus inclined is released, the lowered side of the operating member 3 is raised by the bounce of the hollow protrusion 5*a* of the click rubber member 5, transmitted through the rotating member 6*a*, and the operating member 3 is restored to the initial state shown in FIG. 4. As a result, the movable contact 8*a*, which has been in contact with the stationary contact 4*a*, is separated therefrom, whereby the non-conductive (OFF) state is restored.

Next, the range for inclination of the operating member 3 will be described. First, suppose the operating member 3 is inclined in one of the directions indicated by the arrows 9*b* on the surface of the operating knob 9 of the operating member 3. For example, when the operating member 3 is inclined in the direction of the rotating member 6*b* in accordance with the arrow 9*b* of the operating member 3, as shown in FIG. 6B, the hollow protrusion 5*b* is thereby pressed through the rotating member 6*b*, and the movable contact provided in the hollow protrusion 5*b* is brought into contact with the pair of stationary contacts 4*b* on the base plate 4, whereby the ON state is achieved. In this case, the operating member 3 is pressed at a position between the two protrusions 17*a* and 17*b*, so that the requisite stroke amount for the lower surface of the base 10 to be brought into contact with the protrusions 17*a* and 17*b* is relatively large. In this embodiment, when the operating member 3 has been inclined by approximately 6°, the lower surface of the base 10 abuts the protrusions 17*a* and 17*b* to block further inclination of the operating member 3. This also applies to the case in which, as shown in FIG. 6A, the operating member 3 is inclined in the direction of the rotating member 6*a*, and a case in which the operating member 3 is inclined in the direction of the rotating member 6*c* or 6*d*.

A case in which the operating member 3 is inclined in a direction deviated from the arrow 9*b* will be considered. For example, when, as shown in FIG. 6D, the operating member 3 is inclined in the direction of the protrusion 17*a*, which is deviated from the arrow 9*b* by 45°, the hollow protrusions 5*a* and 5*b* are pressed by the rotating members 6*a* and 6*b*, positioned on either side of the protrusion 17*a*. In this case, the operating member 3 is pressed at a position immediately above the protrusion 17*a*, so that the requisite stroke amount for the lower surface of the base 10 to abut against the protrusion 17*a* is small. In this embodiment, when the operating member 3 has been inclined by approximately 4°, the lower surface of the base 10 abuts the protrusion 17*a* to thereby block further inclination of the operating member 3. Thus, the pressing by the rotating members 6*a* and 6*b* is stopped before the hollow protrusions 5*a* and 5*b* have been buckled. The movable contacts 8*a*, etc., provided in the hollow protrusions 5*a* and 5*b*, are not brought into contact with the stationary contacts 4*a* and 4*b*, but kept in the OFF state. This also applies to the cases in which the operating member 3 is inclined in the direction of the protrusion 17*b*, 17*c* or 17*d*.

Thus, in the above-described embodiment, when the operating member 3 is inclined in an arbitrary direction indicated by one of the arrows 9*b*, for example, in the way as shown in FIG. 5, the middle section of the rotating member 6*a*, positioned in the direction of inclination, is driven to rotate on one end thereof and press the top end surface of the hollow protrusion 5*a*, so that, as is obvious from the principle of the lever, it is possible to set the requisite operating force for operating the operating member 3 at a level higher than the pressing force with which the top end surface of the hollow protrusion 5*a* is pressed. That is, in this embodiment, the operating member 3 does not directly press the click rubber member 5. Instead, the principle of the lever due to the rotating members 6*a*–6*d* is utilized, so that the durability of the click rubber member 5 can be enhanced even when the operating load of the click rubber member 5 is increased, which would otherwise lead to a deterioration in durability. Further, it is also possible to improve the operating feel. Further, when, as in the above case, the operating member 3 is inclined in the direction of the rotating member 6*a*, only the hollow protrusion 5*a* is pressed, with the other hollow protrusions not being pressed, so that an operating feel in one-to-one correspondence with the buckling of the hollow protrusion 5*a* is obtained, thereby achieving an improvement in operability. Further, since the operating member 3 is restored to the neutral position by utilizing the resilient force of the hollow protrusions 5*a*–5*d*, the click feel obtained upon the buckling of the hollow protrusion is not impaired by some other elastic member, so that the operating feel obtained upon the buckling can be made satisfactory. Further, by varying the resilient force of the click rubber member 5, the operating force of the operating member 3 can be easily changed. Further, when the operating member 3 is inclined by a predetermined angle, the rotation fulcrum and the pressing section of each of the rotating members 6*a*–6*d* respectively abut the annular section 15 of the holding member 7 and the hollow protrusions 5*a*–5*d* of the click rubber member 5 so as to block further rotation of the rotating members 6*a*–6*d*, thereby providing a stopper feel indicating the termination of the inclining operation, whereby the operating feel is stabilized.

In the above-described embodiment, when the operating member 3 is inclined in an arbitrary direction, the corresponding one of the rotating members 6*a*–6*d* rotates to press the top end surface of the corresponding one of the hollow protrusions 5*a*–5*d*. Since the top end surfaces of the hollow protrusions are not flat but formed as curved surfaces, the rotating members 6*a*–6*d* are in point contact with the hollow protrusions 5*a*–5*d*, the contact section moving with the rotation of the rotating members 6*a*–6*d*, whereby a directly downward pressing force is constantly applied to the hollow protrusions 5*a*–5*d*. Thus, the inner surfaces of the hollow protrusions 5*a*–5*d* are kept parallel with respect to the surface of the base plate 4 even when the hollow protrusions 5*a*–5*d* are in the buckled state. As a result, the movable contacts 8*a*, etc., provided in the hollow protrusions 5*a*–5*d*, are reliably brought into contact with the stationary contacts 4*a*–4*d* on the surface of the base plate 4, thereby providing a stable contact state. Further, due to the symmetrical configuration of the hollow protrusions 5*a*–5*d*, a satisfactory operating feel can be obtained when the hollow protrusions are buckled. In addition, the molding process for the click rubber member 5 is simplified, thereby attaining a reduction in production cost.

In the above-described embodiment, the range of inclination for the operating member 3 is restricted by the protrusions 17*a*–17*d* provided on the annular section 15 of the holding member 7, so that it is possible to prevent two or more pairs of contact sections from being simultaneously turned on. Further, since the protrusions 17*a*–17*d* are arranged above the click rubber member 5, the click rubber member 5 can cover the entire range of the base plate 4, including the stationary contacts 4*a*–4*d*, so that, even if some liquid, such as water or juice, intrudes the housing 2 through the openings 1, 1*a*, etc., the liquid does not reach the stationary contacts 4*a*–4*d* of the base plate 4 through the click rubber member 5, thus providing an enhanced waterproofness for the contact sections. Further, when the operating member 3 is to be inclined in two or more different directions, the operating member 3, inclined in one direction, need not be temporarily restored to the neutral position but can be directly and quickly inclined in the other direction.

In the above-described embodiment, the spherical section 11 of the base 10 is swingably held in the accommodating section 16 of the holding member 7, so that, although the operating member 3 can be operated to incline, the entire operating member 3 is not lowered even if the operating knob 9 is pushed directly downwards. This also helps to improve the operating feel. Further, since the joint sections 14 provided in the base 10 are inserted into the slits 16*a*, provided in the accommodating section 16, a free rotation of the operating member 3 is blocked, and a directionality as indicated by the arrows 9*b* can be imparted to the operating member 3. Further, since an appropriate elasticity can be imparted to the accommodating section 16 by the slits 16*a*, there is no play between the spherical section 11 and the accommodating section 16, thereby enabling the operating member 3 to be held without rattling. Further, by adopting such a construction, the positional relationship between the four driving members 13*b* on the side of the operating member 3 and the rotating members 6*a*–6*d* is automatically determined. Further, by engaging the four protrusions 15*a* of the holding member 7 with the engagement grooves 2*a* of the housing 2, the holding member 7 is positioned with respect to the base plate 4 and the click rubber member 5 inside the housing 2, thereby enhancing the positional accuracy of the power transmission system which extends from the operating member 3 to the hollow protrusions 5*a*–5*d* through the rotating members 6*a*–6*d*, thereby stabilizing the requisite operating force for the operating member 3.

Although the above embodiment has been described with reference to a 4-way switch using four pairs of switching elements composed of stationary contacts 4*a*–4*d*, movable contacts 8*a*, 8*c*, etc., the number of pairs of switching elements is not limited to that in the above example. The present invention is also applicable to, for example, a 2-way switch using two pairs of switching elements. Further, while the above embodiment has been described with reference to a case in which the protrusions 17*a*–17*d* are provided on the annular section 15 of the holding member 7, it is also possible for the protrusions 17*a*–17*d* to be provided on the lower surface of the base 10, instead of on the annular section 15, or appropriately divide them between the annular section 15 and the base 10. Such an arrangement also provides the same effect as in the above-described case.

As described above, according to the present invention, it is possible to set the inclining force of the operating member at a level higher than that of the pressing force for pressing the hollow protrusions of the click rubber member. Further, since the click feel caused by the buckling of the hollow protrusions is not impaired, it is possible to achieve an improvement in operability. Further, in accordance with the present invention, it is possible to enhance the stability in contact between the movable and stationary contacts, and, at the same time, simplify the click rubber member molding process to thereby achieve a reduction in production cost and an improvement in operating feel. Further, in accordance with the present invention, it is possible to prevent two or more pairs of switching elements from being simultaneously turned on while securing the requisite waterproofness for contact sections. Further, when the operating member is to be inclined in two or more different directions, the inclining operations can be quickly executed.

What is claimed is:

1. A multi-way flipping switch comprising:

a housing having an opening;

an operating member partly protruding through the opening and pivotally retained so as to be pivotable in a plurality of directions;

a base plate on which a plurality of stationary contacts are arranged;

a click rubber member having a plurality of hollow protrusions, each hollow protrusion being located over a corresponding one of the plurality of stationary contacts and having an end portion protruding toward the operating member;

a plurality of movable contacts, each movable contact respectively provided on an inner surface of an end portion of a corresponding one of the hollow protrusions; and a plurality of rotating members for transmitting an operational force of the operating member to outer surfaces of the hollow protrusions, each of the rotating members being rotatable around a fulcrum and having a free end supported by an outer surface of an associated one of the hollow protrusions of the click rubber member, wherein the operating member includes a plurality of driving sections, each driving section contacting an associated rotating member such that when the operating member pivots in a predetermined direction, the driving section forces the free end of the associated rotating member into an associated hollow protrusion, thereby collapsing the hollow protrusion, each driving section being positioned to contact an associated rotating member at a position between the fulcrum and the free end of the rotating member which presses the associated hollow protrusion.

2. The multi-way flipping switch of claim 1 wherein each of said hollow protrusions includes a curved upper surface contacting an associated rotating member.

3. A multi-way flipping switch comprising:

a housing having an opening;

an operating member partly protruding through the opening and pivotally retained so as to be pivotable in a plurality of directions;

a base plate on which a plurality of stationary contacts are arranged;

a click rubber member having a plurality of hollow protrusions, each hollow protrusion being located over a corresponding one of the plurality of stationary contacts and having an end portion protruding toward the operating member;

a plurality of movable contacts, each movable contact respectively provided on an inner surface of an end portion of a corresponding one of the hollow protrusions;

a holding member mounted in the housing; and a plurality of rotating members, each of the rotating members having a first end rotatably connected to the holding member and a second end continuously contacting an outer surface of an associated one of the hollow protrusions of the click rubber member, wherein the operating member includes a plurality of driving sections, each driving section contacting an associated rotating member such that when the operating member pivots in a first predetermined direction, a first driving section forces the second end of a first rotating member into a first hollow protrusion, thereby collapsing the first hollow protrusion, and when the operating member pivots in a second predetermined direction, a second driving section forces the second end of a second rotating member into a second hollow protrusion, thereby collapsing the second hollow protrusion, and wherein a plurality of protrusions are provided on the outer annular section of the operating member, one of the plurality of protrusions being located between the first and second hollow protrusions such that pivoting of the operating member in a direction between the first and second predetermined directions is restricted by said protrusion, thereby preventing a simultaneous collapse of the first and second hollow protrusions.

4. The multi-way flipping switch of claim 3 wherein said plurality of protrusions are spaced apart by 90° relative to the a center of the operating member.

5. A multi-way flipping switch comprising:

a housing having an opening;

an operating member partly protruding through the opening and pivotally retained so as to be pivotable in a plurality of directions;

a base plate on which a plurality of stationary contacts are arranged;

a click rubber member having a plurality of hollow protrusions, each hollow protrusion being located over a corresponding one of the plurality of stationary contacts and having an end portion protruding toward the operating member; a plurality of movable contacts, each movable contact respectively provided on an inner surface of an end portion of a corresponding one of the hollow protrusions;

a holding member mounted in the housing; and a plurality of rotating members, each of the rotating members having a first end rotatably connected to the holding member and a second end continuously contacting an outer surface of an associated one of the hollow protrusions of the click rubber member, wherein the operating member includes a plurality of driving sections, each driving section contacting an associated rotating member such that when the operating member pivots in a first predetermined direction, a first driving section forces the second end of a first rotating member into a first hollow protrusion, thereby collapsing the first hollow protrusion, and when the operating member pivots in a second predetermined direction, a second driving section forces the second end of a second rotating member into a second hollow protrusion, thereby collapsing the second hollow protrusion, and wherein a plurality of protrusions are provided on the holding member, one of the plurality of protrusions being located between the first and second hollow protrusions such that pivoting of the operating member in a direction between the first and second predetermined directions is restricted by said protrusion, thereby preventing a simultaneous collapse of the first and second hollow protrusions.

6. The multi-way flipping switch of claim 5 wherein said plurality of protrusions are spaced apart by 90° relative to the a center of the operating member.

* * * * *